US007458573B2

(12) United States Patent
Park

(10) Patent No.: US 7,458,573 B2
(45) Date of Patent: Dec. 2, 2008

(54) MEDIA PICK-UP DEVICE OF MEDIA DISPENSER

(75) Inventor: Eung Min Park, Seoul (KR)

(73) Assignee: LG N-SYS Inc., Seoul (KR)

( * ) Notice: Subject to any disclaimer, the term of this patent is extended or adjusted under 35 U.S.C. 154(b) by 551 days.

(21) Appl. No.: 10/726,535

(22) Filed: Dec. 4, 2003

(65) Prior Publication Data

US 2004/0113353 A1 Jun. 17, 2004

(30) Foreign Application Priority Data

Dec. 11, 2002 (KR) ..... 10-2002-0078882

(51) Int. Cl.
*B65H 3/52* (2006.01)

(52) U.S. Cl. ..... 271/122

(58) Field of Classification Search ..... 271/4.1, 271/10.11, 122, 125, 272, 188, 274
See application file for complete search history.

(56) References Cited

U.S. PATENT DOCUMENTS 4,085,929 A * 4/1978 Tuchiya et al. ..... 271/122
4,106,767 A * 8/1978 Schirrmeister et al. ..... 271/188
4,195,832 A * 4/1980 Krumrey ..... 271/274
4,871,162 A * 10/1989 Imai et al. ..... 271/35
5,615,874 A * 4/1997 Parthasarathy et al. ..... 271/121
5,711,518 A * 1/1998 Portaro et al. ..... 271/10.03
5,874,979 A * 2/1999 Ohyama ..... 347/104
5,934,665 A * 8/1999 Kasahara ..... 271/122
6,234,470 B1 * 5/2001 Okitsu et al. ..... 271/114
6,318,714 B1 * 11/2001 Beskitt et al. ..... 271/10.01
2002/0060395 A1 * 5/2002 Otake et al. ..... 271/121

FOREIGN PATENT DOCUMENTS

GB 2132737 * 7/1984
JP 1-192661 * 8/1989
JP 2-282160 * 11/1990
JP 3-83741 * 4/1991
JP 6-179538 * 6/1994
JP 6-227681 * 8/1994

* cited by examiner

*Primary Examiner*—Patrick Mackey
*Assistant Examiner*—Thomas A Morrison
(74) *Attorney, Agent, or Firm*—Birch, Stewart, Kolasch & Birch, LLP

(57) ABSTRACT

The present invention discloses a media pick-up device of a media dispenser including a plurality of conveying rollers rotated by a driving force of a driving means, for conveying media, first separating rollers arranged with predetermined overlaps to the conveying rollers, for separating the media one by one, and second separating rollers arranged to face the conveying rollers with predetermined gaps, for generating a frictional force to the media. The media pick-up device of the media dispenser can accurately separate the media one by one regardless of variations of stiffness of the media.

2 Claims, 5 Drawing Sheets

MEDIA PICK-UP DEVICE OF MEDIA DISPENSER

This Non-provisional application claims priority under 35 U.S.C. 119(a) on Patent Application No(s). 10-2002-0078882 filed in Korea on Dec. 11, 2002, the entire contents of which are hereby incorporated by reference.

BACKGROUND OF THE INVENTION

1. Field of the Invention

The present invention relates to a media dispenser, and more particularly, to a media pick-up device of a media dispenser which can separate media one by one regardless of variations of stiffness of the media.

2. Description of the Background Art

FIG. 1 is a side diagram illustrating a conventional media pick-up device of a media dispenser, and FIG. 2 is an enlarged diagram illustrating part A of FIG. 1.

The conventional media pick-up device includes a pick-up roller (not shown) installed in the rear side of media 202 discharged from a media cassette (not shown), for discharging the media stored in the media cassette to the lower side direction by friction, and conveying rollers 204 and separating rollers 206 installed in the lower side of the pick-up roller, for separating and conveying the media 202 discharged from the pick-up roller one by one.

The conveying rollers 204 are fixed to a rotation shaft 208 at predetermined intervals, and the rotation shaft 208 is rotated by a force of a driving unit. The separating rollers 206 are at a stationary state or rotated in the opposite direction to the conveying rollers 204, to separate the media 202 one by one.

The conveying rollers 204 and the separating rollers 206 are arranged with predetermined overlaps (P), to generate friction to the media 202. That is, when the media 202 are inserted between the conveying rollers 204 and the separating rollers 206, a normal force is generated due to stiffness of the media 202, and thus a frictional force is generated between the media 202 and the separating rollers 206. Accordingly, the media 202 are separated and discharged one by one between the conveying rollers 204 and the separating rollers 206.

In the conventional media pick-up device, stiffness of the media 202 is reduced due to moisture in a humid area or humid season such as the wet season. Therefore, when the media 202 pass between the conveying rollers 204 and the separating rollers 206, the normal force generated on the separating rollers 206 decreases, and the frictional force generated between the separating rollers 206 and the media 202 is reduced. As a result, the media 202 cannot be separated one by one.

SUMMARY OF THE INVENTION

Therefore, an object of the present invention is to provide a media pick-up device of a media dispenser which can accurately separate media one by one by maintaining a frictional force between the media and separating rollers, by changing gaps between conveying rollers and the separating rollers, when the media have low stiffness.

To achieve these and other advantages and in accordance with the purpose of the present invention, as embodied and broadly described herein, there is provided a media pick-up device of a media dispenser, including: a plurality of conveying rollers rotated by a driving force of a driving means, for conveying media; first separating rollers arranged with predetermined overlaps to the conveying rollers, for separating the media one by one; and second separating rollers arranged to face the conveying rollers with predetermined gaps, for generating a frictional force to the media.

In order to maintain predetermined intervals between the conveying rollers and the first and second separating rollers, first spacer rollers are mounted on a rotation shaft to which the conveying rollers are fixed, and second spacer rollers corresponding to the first spacer rollers are mounted on a shaft to which the first and second separating rollers are fixed.

The conveying rollers include first conveying rollers arranged with predetermined overlaps to the first separating rollers, and second conveying rollers arranged to face the second separating rollers with predetermined gaps.

The second conveying rollers are arranged between the first conveying rollers at predetermined intervals, and the second separating rollers are arranged between the first separating rollers.

A torsion spring for providing an elastic force to push the first and second separating rollers to the conveying rollers is installed on the shaft to which the first and second separating rollers are fixed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A media dispenser in accordance with the most preferable embodiment of the present invention will now be described with reference to the accompanying drawings.

Figure 1:
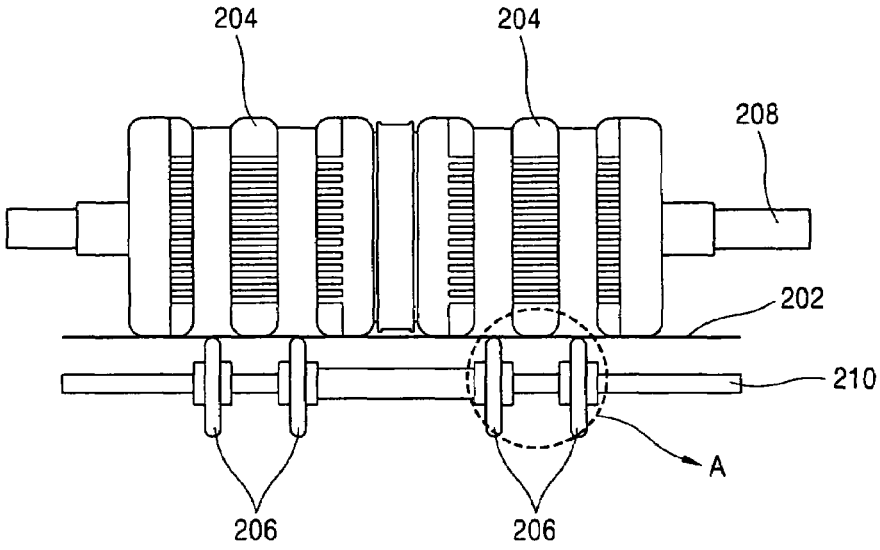
FIG. 1 CONVENTIONAL ART
FIG. 1 is a side diagram illustrating a conventional media pick-up device of a media dispenser.
Figure 2:
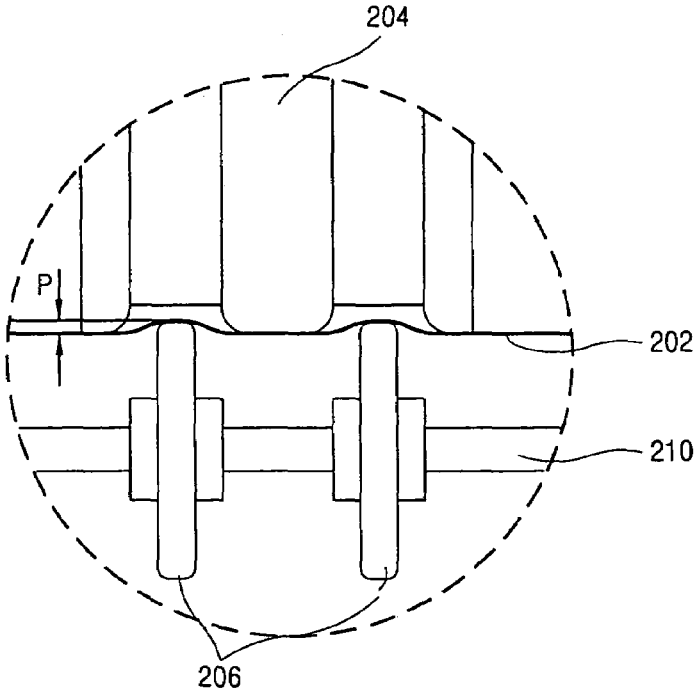
FIG. 2 CONVENTIONAL ART
FIG. 2 is an enlarged diagram illustrating part A of FIG. 1.
Figure 3:
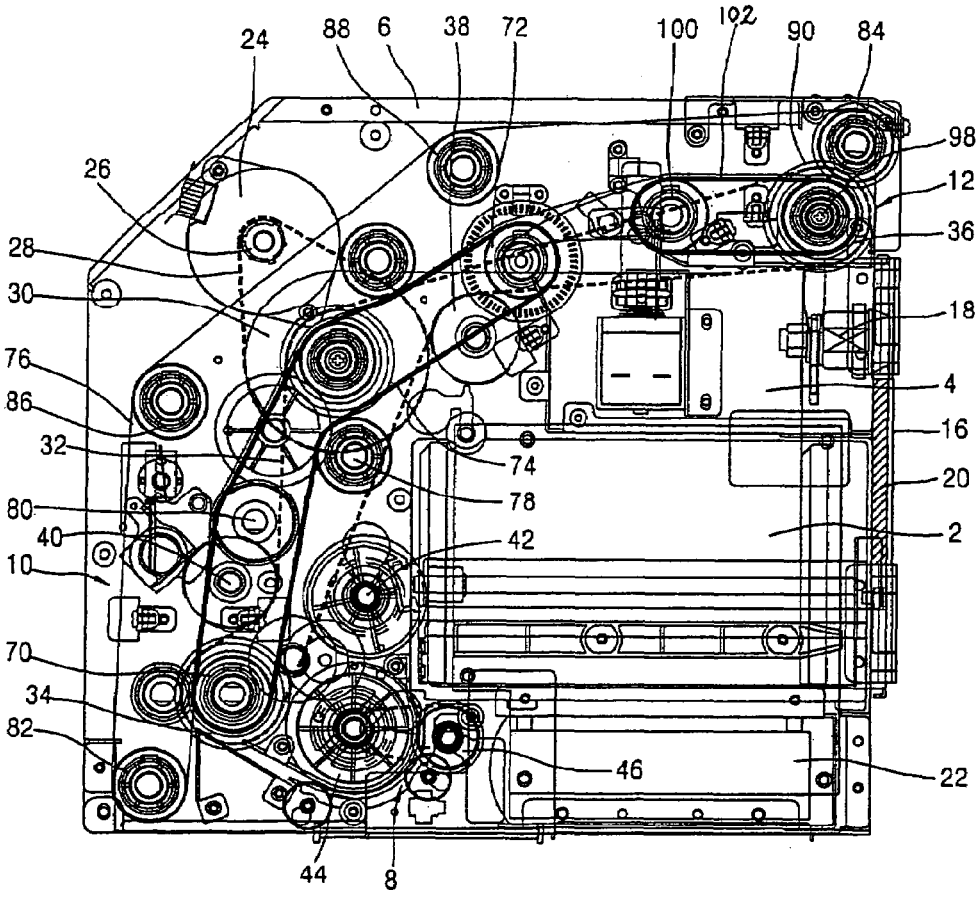
FIG. 3 is a structure diagram illustrating a media dispenser in accordance with the present invention.

FIG. 3 is a structure diagram illustrating the media dispenser in accordance with the present invention.

The media dispenser includes a main body 6 having a media cassette 2 for storing media and a reject box 4 for rejecting defective media, a media pick-up device 8 installed in the lower side of the main body 6, for separating and discharging the media stored in the media cassette 2 one by one, a media conveying device 10 for conveying the media discharged from the media pick-up device 8, a media discharge device 12 for externally discharging the media conveyed by the media conveying device 10, a driving means for providing a driving force for driving each device, a force transmitting means for transmitting the driving force generated in the driving means to each device, and a media rejecting means for rejecting defective media during the media transmission process.

A receiving space of the media cassette 2 is formed in the front side of the main body 6, a receiving space of the reject box 4 for rejecting the defective media is formed in the upper side of the receiving space, and a door 16 is mounted on the front sides of the two receiving spaces.

A locking system 18 for preventing non-designated users from accessing the media cassette 2 and the reject box 4 is installed on the door 16. A cushion member 20 adhered to the front surface of the media cassette 2 for buffering is installed on the inside surface of the door 16.

A power board 22 for allowing various components of the media dispenser to use external power is mounted in the lower side of the receiving space of the media cassette 2 of the main body 6.

The driving means is a driving motor 24 mounted on one side of the base plate 6, for generating a rotational force, and a driving pulley 26 is mounted on the driving motor 24.

The power transmitting means serves to transmit the force generated in the driving motor 24 to each unit. The driving pulley 26 of the driving motor 24 is connected to a driven pulley 30 by a driving belt 28, for transmitting the driving force to the driven pulley 30, a timing belt 32 is wound up on the driven pulley 30, a lower end connecting pulley 34 for driving the media pick-up device 8 is wound up on the lower end of the timing belt 32, and an eject pulley 36 for driving the media discharge device 12 is wound on the upper end of the timing belt 32.

A plurality of tension pulleys 38 and 40 for maintaining tension of the timing belt 32 are installed in one side of the timing belt 32.

The lower end connecting pulley 34 transmits the rotational force generated by the rotation of the timing belt 32 to the media pick-up device 8. In addition, the lower end connecting pulley 34 is connected to the media conveying device 10, for transmitting the rotational force to the media conveying device 10.

The media conveying device 10 guides the media discharged from the media pick-up device 8 to the media discharge device 12, and includes a first feed belt 74 wound up between a first conveying roller 70 installed on the same axis as the lower end connecting pulley 34 and a second conveying roller 72 positioned in the upper side thereof, and a second feed belt 76 rotated with the first feed belt 74 in a contact state, for conveying the media.

The first feed belt 74 is wound up between the first conveying roller 70 rotated with the lower end connecting pulley 34 and the second conveying roller 72 positioned in the upper side thereof, and rotated by the rotational force from the lower end connecting pulley 34. A plurality of guide rollers 78 and 80 for guiding a path of the media are rotatably installed in one side of the first feed belt 74.

The second feed belt 76 is rotated in the same direction as the first feed belt 74 with its inside surface connected to contact the outside surface of the first feed belt 74, and wound up between a third conveying roller 82 rotatably installed in the lower side of the main body 6 and a fourth conveying roller 84 rotatably installed in the upper end of the front side of the main body 6.

A plurality of guide rollers 86 and 88 for guiding a path of the second feed belt 76 are rotatably installed in one side of the second feed belt 76.

Here, the fourth conveying roller 84 is arranged on the same axis as a gear 90 gearing into the eject pulley 36 on which the timing belt 32 is wound up, for receiving the rotational force and driving the second feed belt 76.

In the media conveying device 10, when the driving motor 24 is driven, the timing belt 32 is rotated, and thus the lower end connecting pulley 34 and the eject pulley 36 are rotated. The first conveying roller 70 arranged on the same axis as the lower end connecting pulley 34 is rotated to rotate the first feed belt 74, and the fourth conveying roller 84 gearing into the eject pulley 36 is rotated to rotate the second feed belt 76.

Accordingly, the media discharged from the media pick-up device 8 are conveyed between the first feed belt 74 and the second feed belt 76, and guided to the media discharge device 12.

The media discharge device 12 serves to transmit the media conveyed by the media conveying device 10 to the user, and includes a first discharge roller 98 installed on the same axis as the eject pulley 36 and rotated with the eject pulley 36, and a second discharge roller 100 connected to the first discharge roller 98 by a discharge belt 102 and rotated. The discharge belt 102 is rotated in the same direction as the second feed belt 76 in a contact state with the upper side of the second feed belt 76, for externally discharging the media.

Figure 4:
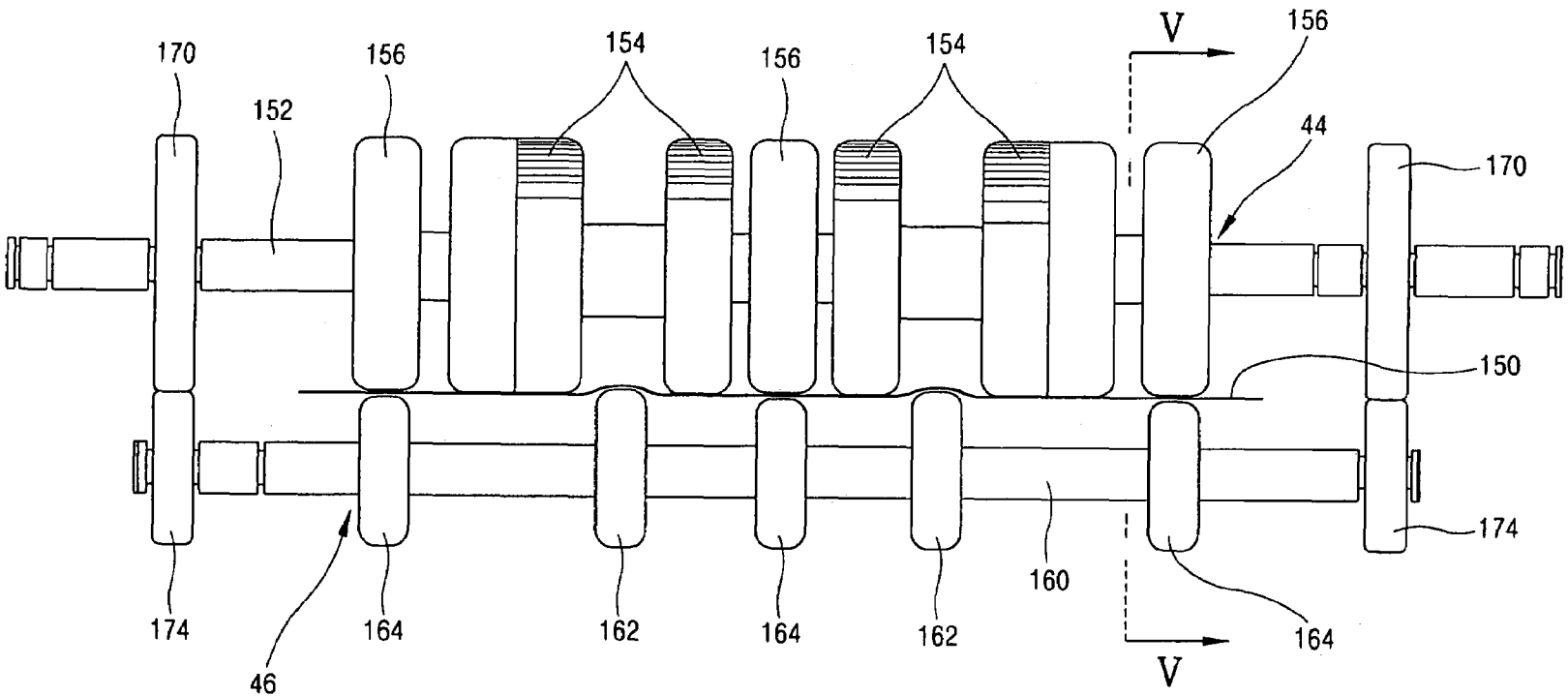
FIG. 4 is a side diagram illustrating a media pick-up device of the media dispenser in accordance with the present invention.

FIG. 4 is a side diagram illustrating the media pick-up device of the media dispenser in accordance with the present invention.

The media pick-up device includes a pick-up roller 42 positioned in the rear side of the media cassette 2, for discharging media 150 stored in the media cassette 2 to the lower side direction, a conveying roller unit 44 rotated by the driving force of the driving means, and a separating roller unit 46 arranged to face the conveying roller unit 44, for separating the media one by one by generating a frictional force to the media.

Here, the conveying roller unit 44 is comprised of a rotation shaft 152 connected to the driving means through the force transmitting means and rotated, first conveying rollers 154 mounted on the rotation shaft 152, and rotated with the rotation shaft 152, for conveying the media 150 when the media 150 have normal stiffness, and second conveying rollers 156 for conveying the media 150 when the media 150 have low stiffness.

The separating roller unit 46 includes a shaft 160 maintaining a stationary state or being rotated in the opposite direction to the conveying rollers, first separating rollers 162 fixed to the shaft 160 and positioned with predetermined overlaps Q to the first conveying rollers 154, for separating the media 150 one by one by generating the frictional force to the media 150 when the media 150 have normal stiffness, and second separating rollers 164 arranged to face the second conveying rollers 156 with predetermined gaps T, for generating the frictional force to the media 150 when the media 150 have low stiffness.

Preferably, the second conveying rollers 156 are arranged between the first conveying rollers 154 at predetermined intervals, and the second separating rollers 164 are arranged between the first separating rollers 162.

First spacer rollers 170 are mounted on both sides of the rotation shaft 152 of the conveying roller unit 44, and second spacer rollers 174 corresponding to the first spacer rollers 170 are mounted on both sides of the shaft 160 of the separating roller unit 46, to maintain a predetermined interval between the conveying roller unit 44 and the separating roller unit 46.

Figure 5:
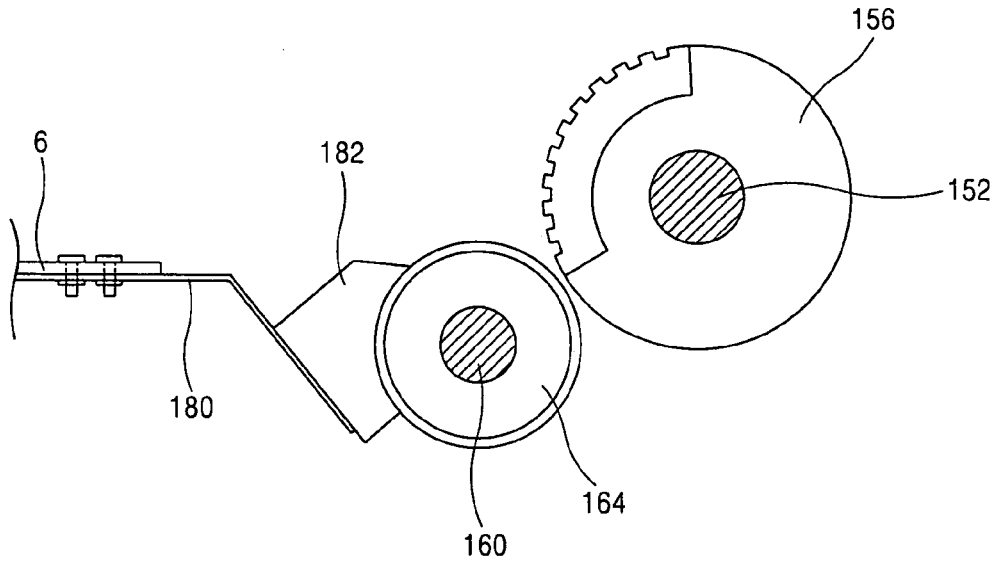
FIG. 5 is a cross-sectional diagram taken along line V-V of FIG. 4.

As shown in FIG. 5, a torsion spring 180 for providing an elastic force to the conveying roller unit 46 to push the conveying roller unit 46 to the separating roller unit 44 is installed in the separating roller unit 46.

That is, the torsion spring 180 preferably includes a plate spring fixed between a bracket 182 rotatably supported on the shaft 160 of the separating roller unit 46 and the main body 6, for pushing the separating roller unit 46 to the conveying roller unit 44.

Here, the elastic force of the torsion spring 180 for pushing the separating roller unit 46 is set according to stiffness of the media 150. That is, when the media 150 have normal stiffness, the second conveying rollers 156 and the second separating rollers 164 maintain the predetermined gaps T due to stiffness of the media 150 passing between the first conveying rollers 154 and the first separating rollers 162, and when the media 150 have low stiffness, the force of the torsion spring 180 is applied to the conveying roller unit 44 to reduce the gaps between the second conveying rollers 156 and the second separating rollers 164, thereby generating the frictional force to the media 150.

Figure 6:
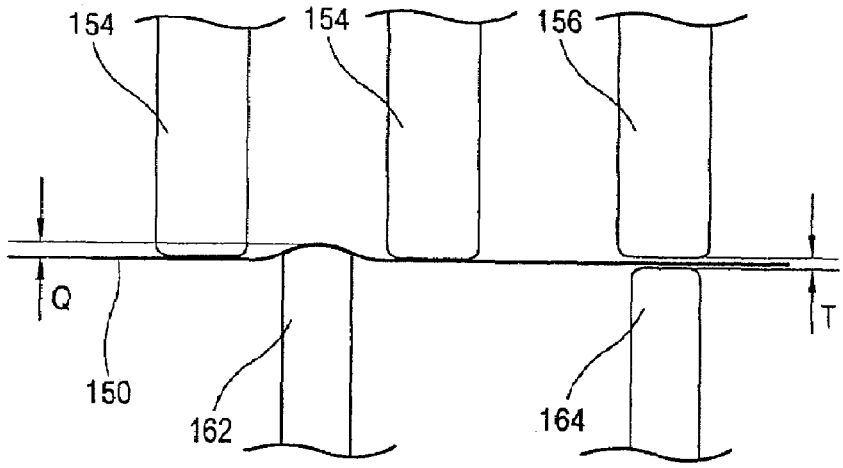
FIGS. 6 and 7 are operation status diagrams illustrating the media pick-up device in accordance with the present invention.
Figure 7:
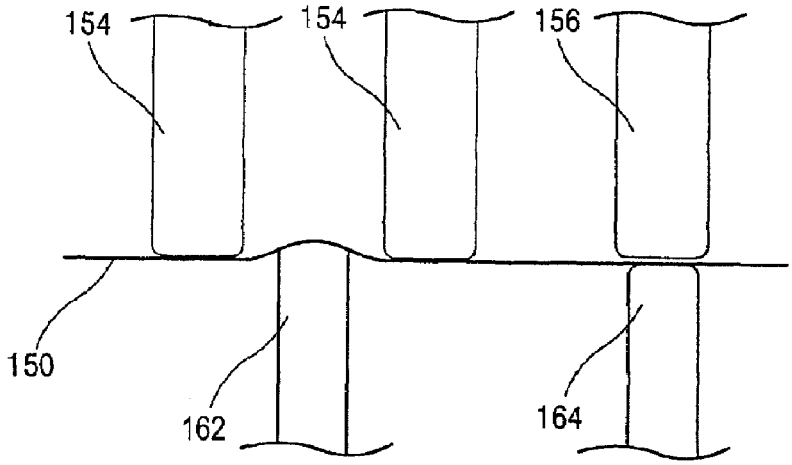

FIGS. 6 and 7 are operation status diagrams illustrating the media pick-up device in accordance with the present invention.

When the pick-up roller 42 is rotated to transmit the media 150 stored in the media cassette 2 to the lower side direction, the media 150 are conveyed between the conveying roller unit 44 and the separating roller unit 46, separated one by one, guided by the media conveying device 10, and externally discharged through the media discharge device 12. That is, the conveying roller unit 44 is rotated, and the separating roller unit 46 is at a stationary state or rotated in the opposite direction to the conveying roller unit 44, to separate the media 150 one by one.

When the media 150 have normal stiffness, as shown in FIG. 6, the media 150 rub with the first separating rollers 0.162 by the overlaps Q between the first conveying rollers 154 and the first separating rollers 162, and thus are separated one by one. Because the media 150 have normal stiffness, the torsion spring 180 overcomes the elastic force by stiffness of the media 150, and the predetermined gaps T are maintained between the second conveying rollers 156 and the second separating rollers 164.

In the case that the media 150 have normal stiffness, when the media 150 pass between the first conveying rollers 154 and the first separating rollers 162, a separating force is generated between the first conveying rollers 154 and the first separating rollers 162, to separate the media 150 one by one. Because the gaps T between the second conveying rollers 156 and the second separating rollers 164 are greater than thickness of the media 150, the separating force is not generated between the second conveying rollers 156 and the second separating rollers 164.

As illustrated in FIG. 7, when the media 150 absorb moisture due to the humid area where the media dispenser is installed, or wet season like summer, stiffness of the media 150 is reduced. Here, the separating roller unit 46 moves to the conveying roller unit 44 by the elastic force of the torsion spring 180, to reduce the gaps T between the second conveying rollers 156 and the second separating rollers 164. That is, the gaps T are maintained between 0.1 and 0.2 mm, thereby generating the frictional force to the media 150.

As described above, when the media 150 have low stiffness, the media 150 generate the frictional force between the first conveying rollers 154 and the first separating rollers 162 and between the second conveying rollers 156 and the second separating rollers 164, and thus are accurately separated one by one.

The effects of the media pick-up device in accordance with the present invention will now be explained.

When the media have normal stiffness, the media are separated one by one due to friction by the overlaps between the first conveying rollers and the first separating rollers. When the media have low stiffness, the first conveying rollers and the first separating rollers as well as the second conveying rollers and the second separating rollers are adhered to each other to separate the media. As a result, the media are accurately separated one by one, to improve performance of the media dispenser.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A media pick-up device of a media dispenser, comprising:

a plurality of conveying rollers rotated by a driving force of a driving means, for conveying media;

first separating rollers arranged with overlaps to the conveying rollers to separate the media one by one; and second separating rollers arranged to face an outer surface of the conveying rollers with gaps between the second separating rollers and the conveying rollers, for generating a frictional force to the media;

wherein, in order to maintain intervals between the conveying rollers and all of the separating rollers, first spacer rollers are mounted on a rotation shaft to which the conveying rollers are fixed, and second spacer rollers corresponding to the first spacer rollers are mounted on a shaft to which the first and second separating rollers are fixed.

2. A media pick-up device of a media dispenser, comprising:

a plurality of conveying rollers rotated by a driving force of a driving means, for conveying media;

first separating rollers arranged with overlaps to the conveying rollers to separate the modia one by one; and second separating rollers arranged directly below some of the conveying rollers and arranged to face outer surfaces of the conveying rollers with gaps between the second separating rollers and the conveying rollers, and which form and maintain a gap with the facing outer surfaces of the conveying rollers greater than a thickness of the media for generating a frictional force to the media regardless of a stiffness of the media;

wherein both thc first and second separating rollers are mounted on a same shaft.

* * * * *